US006683265B2

(12) United States Patent
Masuda

(10) Patent No.: US 6,683,265 B2
(45) Date of Patent: Jan. 27, 2004

(54) SWITCH

(75) Inventor: Masazi Masuda, Shizuoka-ken (JP)

(73) Assignee: Fuji Electronic Industries, Ltd., Shizuoka-ken (JP)

( * ) Notice: Subject to any disclaimer, the term of this patent is extended or adjusted under 35 U.S.C. 154(b) by 0 days.

(21) Appl. No.: 10/201,106

(22) Filed: Jul. 23, 2002

(65) Prior Publication Data

US 2003/0221943 A1 Dec. 4, 2003

(30) Foreign Application Priority Data

May 31, 2002 (JP) ..... 2002-159490

(51) Int. Cl.[7] ..... H01H 5/18
(52) U.S. Cl. ..... 200/406; 200/520
(58) Field of Search ..... 200/406, 510–516, 200/402, 405, 341–344, 16 R–16 D, 517, 520, 5 A, 159 A, 159 B

(56) References Cited

U.S. PATENT DOCUMENTS 4,195,210 A * 3/1980 Pounds et al. ..... 200/516
4,476,355 A 10/1984 Mital
6,271,491 B1 * 8/2001 Ono et al. ..... 200/520
6,423,918 B1 * 7/2002 King et al. ..... 200/406
6,495,783 B2 * 12/2002 Rochon et al. ..... 403/22
6,518,527 B2 * 2/2003 Watanabe et al. ..... 200/406

* cited by examiner

*Primary Examiner*—Michael Friedhofer
*Assistant Examiner*—Lisa Klaus
(74) *Attorney, Agent, or Firm*—Flynn, Thiel, Boutell & Tanis, P.C.

(57) ABSTRACT

There is provided a switch which is excellent in stability in electric contact between an edge part of a contact spring and a fixed contact part, ensures a stroke required for an eccentric load which is imposed on the contact spring and reduces variations in clicking feeling without shortening a life of the dome-shaped contact spring which can be clicked. A depression is formed on an inner central part of the contact spring, namely, on a movable contact part and the edge part formed on the periphery of the depression is allowed to contact the surface of the fixed contact part by a line contact, thereby ensuring electric stability of contact between the edge part and the fixed contact part. Since the movable contact part has no hole, no dust enters the switch, thereby preventing a life of the contact spring from being shortened. Further, since the central part of the contact spring is formed in a dome part by a spherical surface and a skirt part is formed of a conical surface on the outer peripheral edge part of the dome part, a required stroke is ensured and variations in clicking feeling are reduced.

20 Claims, 7 Drawing Sheets

SWITCH

FIELD OF THE INVENTION

The invention relates to a switch for receiving signals used in an electric equipment or electronic equipment such as an audio equipment, a video equipment, a communication equipment like a portable telephone, a measuring equipment and the like, particularly to an improvement of a movable dome-shaped contact spring which can be clicked.

BACKGROUND OF THE INVENTION

A switch for use in a signal input part in the forgoing equipment conventionally comprises a dome-shaped contact spring which can be clicked, and a fixed contact part which faces a movable contact part disposed on an interior of the contact spring. A movable contact part having a hole has been recently frequently employed by the contact spring so as to prevent a loose contact between itself and the fixed contact part by a surface contact.

A contact spring is elastically deformed by a pressing force acting on a top thereof when a switch is operated, and a warping direction of the contact spring is reversed while it is clicked. When the warping direction of the contact spring is reversed, an edge part provided on the outer periphery of the hole of the movable contact part and the fixed contact part contact each other by a line contact so that they are rendered in an electrically on state, thereby generating signals in response to an object of the switch. A surface contact between the edge part of the movable contact part and the fixed contact part is substituted for a line contact therebetween so that a contact pressure at the edge part of the movable contact part is increased even if fine dust and the like exist, thereby making extensive improvements for an electric stability of contact between the movable contact part and the fixed contact part.

However, when a movable contact part is bored and a plate-like spring material is formed in a dome shape to manufacture a dome-shaped contact spring which can be clicked, the contact spring is not formed in a uniform dome shape because a spring member springs back after the contact spring was manufactured, and also the amount of movement or stroke serving as operating characteristics becomes large, and further a tensile stress or a compression stress imposed on the periphery of the hole becomes large when the contact spring is repetitively used, so that the periphery of the hole is prone to crack. Accordingly, there arises a problem of a short life of the contact spring. Particularly, since a contact spring has been small in size at present, this problem frequently occurs.

SUMMARY OF THE INVENTION

As a result, it is a first object of the invention to provide a dome-shaped contact spring which can be clicked, and is excellent in an electric stability of contact between a movable contact part and a fixed contact part of the contact spring without shortening a life of a contact spring when the contact spring is repetitively used.

The dome-shaped contact which can be clicked is used together with a printed circuit board in a portable telephone and the like. A conductive pattern on the printed circuit board for use in a switch normally forms, on the same plane, a contact segment corresponding to an outer periphery of the contact spring and a fixed contact part corresponding to a movable contact part at the inner central portion of the contact spring. The dome-shaped contact spring normally contacts the contact segment at its outer periphery, and is reversed when a switch is turned on so that the movable contact part is in pressure contact with the fixed contact part of the conductive pattern, thereby bringing both the contact segment and the fixed contact part of the conductive pattern into an electrical conduction with each other.

When a switch is turned on, namely when the contact spring is reversed, it is effective that the outer peripheral edge part of the dome-shaped contact spring is formed in a shape of skirt by a conical surface so as to ensure that the outer peripheral part of the contact spring is in pressure contact with the contact segment. Further, a skirt-shaped part is not reversed when the contact spring is reversed, and the outer peripheral edge part of the skirt-shaped part is in pressure contact with the contact segment.

Since the stroke of the contact spring is increased or decreased owing to the existence of a skirt-shaped part or depending on the manner of formation of the skirt-shaped part, and a load for reversing the contact spring becomes large and also a returning load for returning the contact spring becomes large when a pressing position is displaced from the central position of the contact part, there arises a problem that clicking feeling becomes worse at the position remote from the central position of the contact spring.

It is therefore a second object of the invention to ensure a stroke of the dome-shaped contact spring required for an eccentric load which is imposed on the dome shaped contact spring when it is pressed, thereby reducing variations in clicking feeling depending on the pressing positions.

To achieve the first object of the invention, a depression is formed on an inner central part of a dome-shaped contact spring which can be clicked, namely, on a movable contact part, and an edge part formed on the periphery of the depression is allowed to contact a surface of a fixed contact part by a line contact, thereby ensuring electric stability of contact between the edge part and fixed contact part, and also preventing a life of contact spring from being shortened without boring the movable contact part.

To achieve the second object of the invention, the central part of the dome-shaped contact spring which can be clicked is formed in a dome part by a spherical surface and an outer edge part of the dome part is formed in a skirt part by a part of one or not less than two conical surfaces, and also an annular demarcating part between the dome part and the skirt part is formed in a bent part, thereby ensuring a stroke of the contact spring which is required when the dome-shaped contact spring is pressed, and reducing variation in clicking feeling depending on the pressing positions.

More in detail, in a switch of the invention comprising the dome-shaped contact spring which can be clicked, the movable contact part formed at the inner central part of the contact spring contacts the fixed contact part or breaks off the contact with the fixed contact part so as to render the movable contact part and the fixed contact part to be in electrically on or off state, wherein a depression is formed on the movable contact part, and the edge part formed on the periphery of the depression is allowed to contact the surface of the fixed contact part (first aspect of the invention).

Further, the switch of the invention comprises, a switch case which houses therein a dome-shaped contact spring which can be clicked and an operation button which is brought into contact with a top of the contact spring and is freely displaced in a direction of the elastic deformation of the contact spring, wherein an outer periphery of the contact spring is brought into contact with the contact segment while the inner central portion of the contact spring serves as a movable contact part, and further the movable contact part contacts the fixed contact part or breaks off the contact with the fixed contact part inside the switch case, thereby rendering the movable contact part and the fixed contact part to be in electrically on or off state, wherein an edge part the switch further comprises a depression on the movable contact part, and the edge part formed on the periphery of the depression is allowed to contact the surface of the fixed contact part (second aspect of the invention).

The central portion of the dome-shaped contact spring which can be clicked is formed in a dome part by a spherical surface wherein the outer peripheral edge part of the dome part is formed to have a single or not less than double step by one or not less than two different conical surfaces, and the annular demarcating part between the dome part and the skirt part and the annular demarcating part between adjacent skirt parts are formed in bent parts (third and fourth aspects of the invention).

The depression of the movable contact part is formed in any of a circular, an elliptical, a polygonal and an astral shape.

BRIEF DESCRIPTION OF THE DRAWINGS

FIG. 2 is a sectional view of the switch and the switch case in a state where the switch of the invention is turned on.

PREFERRED EMBODIMENT OF THE INVENTION

Figure 1:
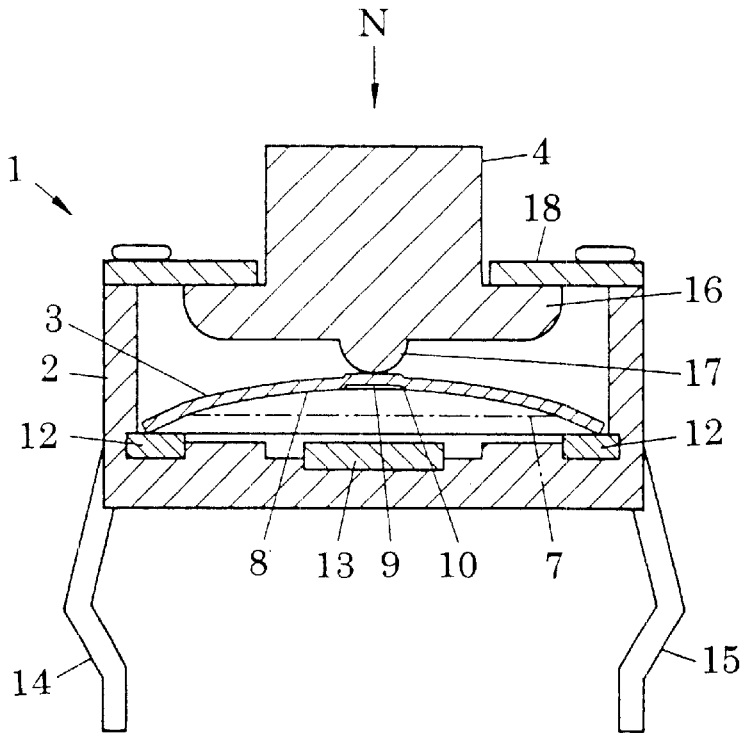
FIG. 1 is a sectional view of a switch and a switch case in a state where the switch of the invention is turned off.
Figure 2:
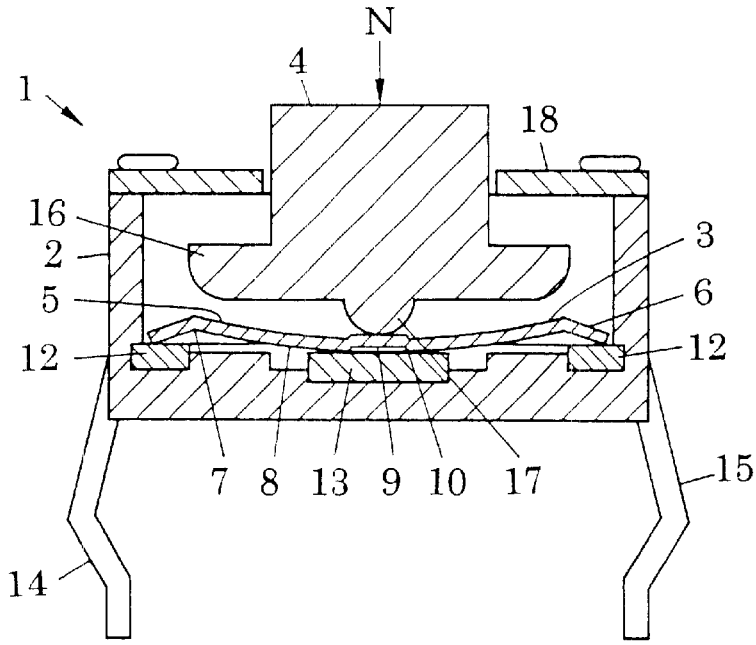

FIG. 1 shows an off state of a switch 1, and FIG. 2 shows an on state of the switch 1. In these figures, the switch 1 comprises a switch case 2 which houses therein a dome-shaped contact spring 3 which can be clicked and an operation button 4 which is brought into contact with the top of the contact spring 3 and can be displaced in a direction of the elastic deformation of the contact spring 3.

Figure 3:
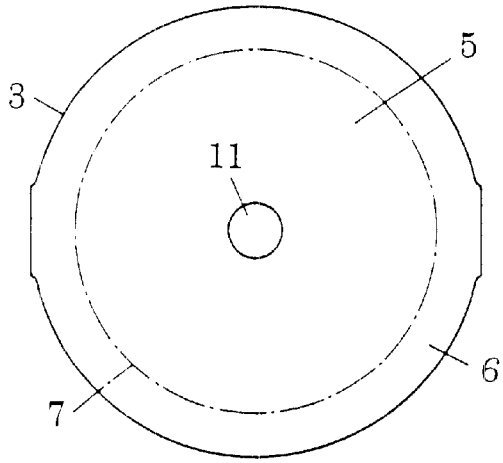
FIG. 3 is a plan view of a contact spring according to the switch of the invention.
Figure 4:
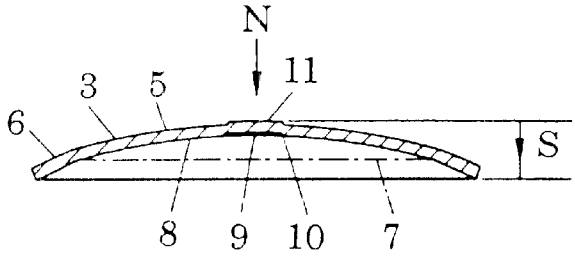
FIG. 4 is a side sectional view of the contact spring according to the switch of the invention.

The contact spring 3 is formed in a dome shape as a whole and is made of a stainless plate having a thickness of, e.g. 0.06 mm and a diameter of e.g. 3.5 mm as shown in FIGS. 3 and 4 as well as FIGS. 1 and 2. The contact spring 3 is integrally formed by a dome part 5 which is formed of a part of spherical surface or a part of an elliptical spherical surface each having a given curvature at the central portion and a skirt part 6 which is formed of a part of a conical surface at the outer peripheral edge part of the dome part 5 and an annular bent part 7 at a demarcating part of the skirt part 6 and the bent part 7. The conical surface of the skirt part 6 has an apex of a cone at the top side (convex side) of the dome part 5. An inner central part of the contact spring 3, namely, a concave central part of the dome part 5 serves as a movable contact part 8 formed of a silver plated layer, and a circular depression 9 is formed on the movable contact part 8, and an edge part 10 is formed on the periphery of the depression 9. The depression 9 is formed at the same time when the contact spring 3 is subjected to punching and bending working by a press machine, and hence a protrusion 11 is formed on an outer surface opposite to the depression 9.

An end of the skirt part 6 of the contact spring 3 contacts annular contact segment 12 which is buried in the bottom of the switch case 2 in a state where they are housed in the interior of the switch case 2, and is rendered in an electrical conductive state. The edge part 10 of the movable contact part 8 faces and contacts a fixed contact part 13 which is buried in the central part of the bottom of the switch case 2, and it is rendered in an electrical conductive state. Both the contact segment 12 and the fixed contact part 13 are integrated with connection terminals 14, 15 which are exposed outside the switch case 2.

The operation button 4 is brought into contact with the protrusion 11 of the dome part 5 of the contact spring 3 by a protrusion 17 inside the switch case 2, and it is freely displaced in the direction of an elastic deformation of the contact spring 3, and further it is held in a state where a part thereof is protruded when a flange part of the operation button 4 is brought into contact with a switch cover 18 which is fixed to the switch case 2.

Figure 5:
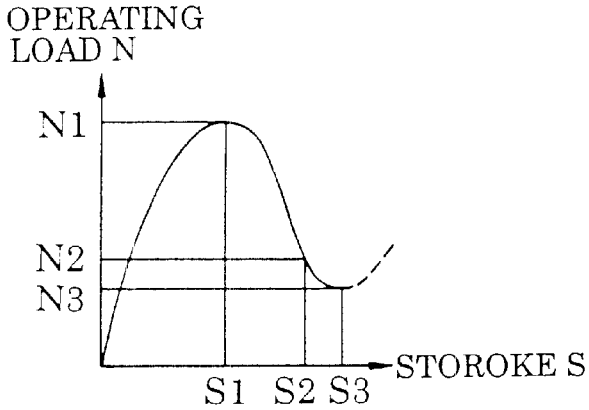
FIG. 5 is a graph showing a relation between a stroke of and an operating load imposed on the contact spring according to the switch of the invention.

FIG. 5 is a graph showing properties of the contact spring 3, namely, an operating load N imposed on the contact spring 3 (axis of ordinance) relative to a stroke S (axis of abscissa) of the contact spring 3. As shown in FIG. 4, if the operating load N is imposed on the central part of the dome part 5 of the contact spring 3 in the direction of a normal line, the stroke S of the movable contact part 8 (edge part 10) is increased substantially in proportion to the operating load N. However, if the stroke S exceeds a stroke S1 where clicking occurs by an operating load N1, the contact spring 3 is reversed in a warping direction by the click action, and hence the contact spring 3 is moved in the direction of the stroke S even by the operating load N which is smaller than the operating load N which has been imposed on the contact spring so far. Thereafter the stroke S is becomes strokes S2, S3 by a force corresponding to the operating loads N2, N3, and the reversed state of the contact spring 3 is maintained. If the operating load N3 is removed, the contact spring 3 is reversed again in an opposite direction and is returned to an original state.

Figure 6:
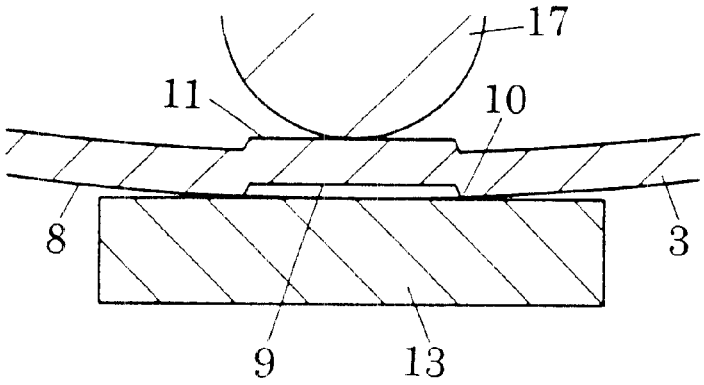
FIG. 6 is an enlarged sectional view showing a part of the state where an edge part of a movable contact part of the contact spring and a fixed contact part are brought into contact with each other according to the switch of the invention.

If an operator presses the operation button 4 downward, the contact spring 3 is elastically deformed in response to the operating load N according to the graph in FIG. 5 showing the properties of the contact spring 3, and becomes in a flat state. If the contact spring 3 exceeds the stroke S1 where the clicking occurs, the dome part 5 of the contact spring 3 reverses bent part 7 in a warping direction as a bending line as shown in FIGS. 2 and 6 so that the edge part 10 of the movable contact part 8 is allowed to contact the surface of the fixed contact part 13 so that they are rendered in an electrical conduction with each other and respectively turned on. Even if the dome part 5 is reversed, the skirt part 6 is not reversed and contacts the contact segment 12 under a given contact pressure in a state before the dome part 5 is reversed, and is conductive with the contact segment 12.

In this on state, the edge part 10 of the movable contact part 8 contacts the surface of the fixed contact part 13 while forming an annular line contact. Accordingly, even if fine dust and the like are stuck on the contact part between the edge part 10 and the fixed contact part 13, the contact pressure of the edge part 10 of the movable contact part 8 relative to the fixed contact part 13 is increased, thereby making extensive improvements for an electric stability of contact between the movable contact part and the fixed contact part and allowing electric characteristics to be excellent.

Further, although bending strain stress generated during press working remains on the periphery of the depression 9 by the formation of the depression 9, the strain stress at the depression 9 is smaller than a shear strain stress generated when forming the hole, and the tensile stress or compression stress imposed on the periphery of the depression 9 is relatively smaller than the hole when the contact spring 3 is elastically deformed. Accordingly, the depression 9 of the contact spring 3 hardly cracks, and hence a life of the contact spring 3 becomes long compared with the conventional contact spring. Further, since the dome part 5 has no hole, no fine dust enters the switch. Meanwhile, it is preferable that a depth of the depression 9 is restricted to be two thirds of a thickness of the plate of the contact spring 3 so as not to exert an influence on spring properties of the contact spring 3.

Figure 7:
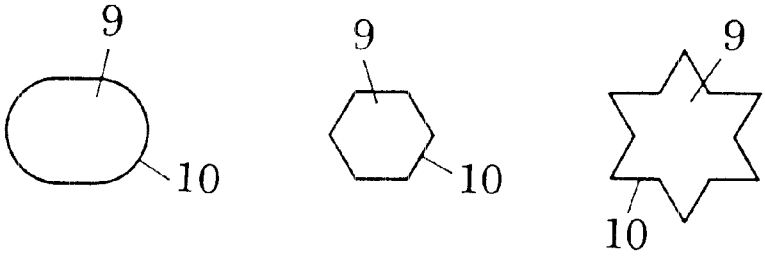
FIG. 7 is plan views of depressions of other configurations according to the switch of the invention.
Figure 8:
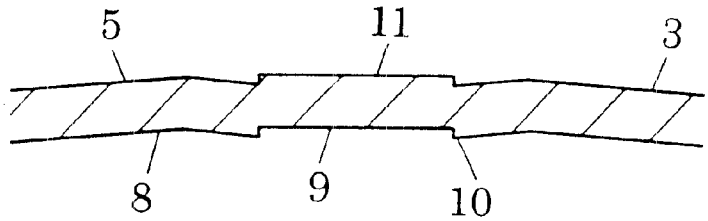
FIG. 8 is enlarged sectional views of a part of another depression according to the switch of the invention.

Further, the shape of the depression 9 is not limited to a circular one, and it may be formed of an elliptical, a polygonal, and an astral shape and the like as shown in FIG. 7. Still further, the depression 9 may be formed by protruding an outer peripheral portion of the movable contact part 8 to form the depression 9 from the movable contact part 8 of the contact spring 3 toward the fixed contact part 13 as shown in FIG. 8. In this case, the edge part 10 is formed between this protruded part and the depression 9. Meanwhile, the depression 9 may be formed of a hemispherical shape. The edge part 10 is annular and continuous as a preferable example, but it may be formed in a discontinuous state.

Figure 9:
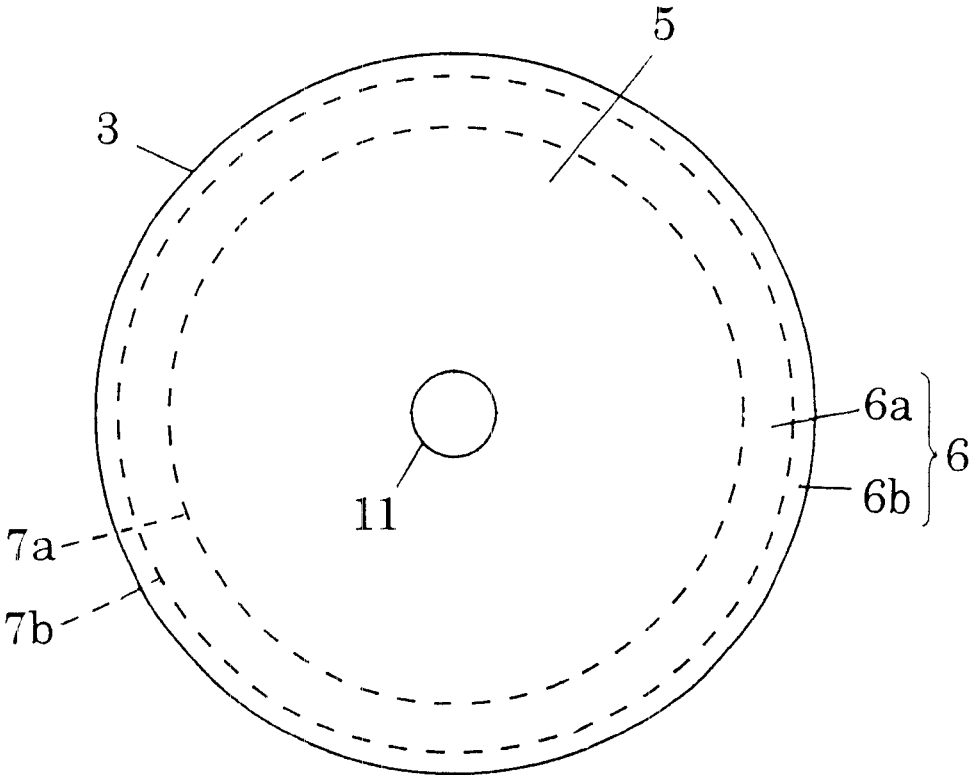
FIG. 9 is a plan view of another contact spring according to the switch of the invention.
Figure 10:
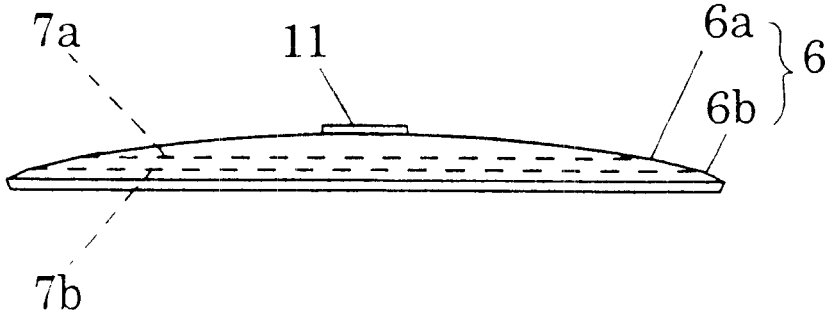
FIG. 10 is a side view of another contact spring according to the switch of the invention.

FIGS. 9 and 10 show a contact spring 3 according to another embodiment. Although the contact spring 3 shown in FIGS. 3 and 4 has a single stepped skirt part 6 formed by a part of a conical surface on the outer peripheral edge of the dome part 5, the contact spring 3 as shown in FIGS. 9 and 10 has a double stepped skirt part 6. The double stepped skirt part 6 is formed by skirt elements 6*a*, 6*b* formed by each part of different two conical surfaces. Bent parts 7*a*, 7*b* become a demarcating part between the dome part 5 and the skirt element 6*a* and another demarcating part between the skirt element 6*a* and the skirt element 6*b*. The skirt part 6 is not limited to the double stepped one but may be formed of triple stepped or more stepped one or multi-stepped, i.e. may be formed of a surface close to a curved surface.

FIGS. 11(A) to 11(D) are views explaining the difference of functions of the contact spring 3. FIGS. 11(A), (B) and (C) show the contact spring 3 having the single stepped skirt part 6 as shown in FIGS. 3 and 4 while FIG. 11(D) shows the contact spring 3 having the double stepped skirt part 6 as shown in FIGS. 9 and 10. The contact spring 3 in FIGS. 11(A) to 11(D) is placed on the plane of a board 19 such as a printed circuit board. In these states as shown in FIGS. 11(A) to 11(D), the movable contact part 8 of the contact spring 3 corresponds to the fixed contact part 13 of the board 19, and the end of the skirt part 6 contacts the contact segment 12 of the board 19.

Figure 11:
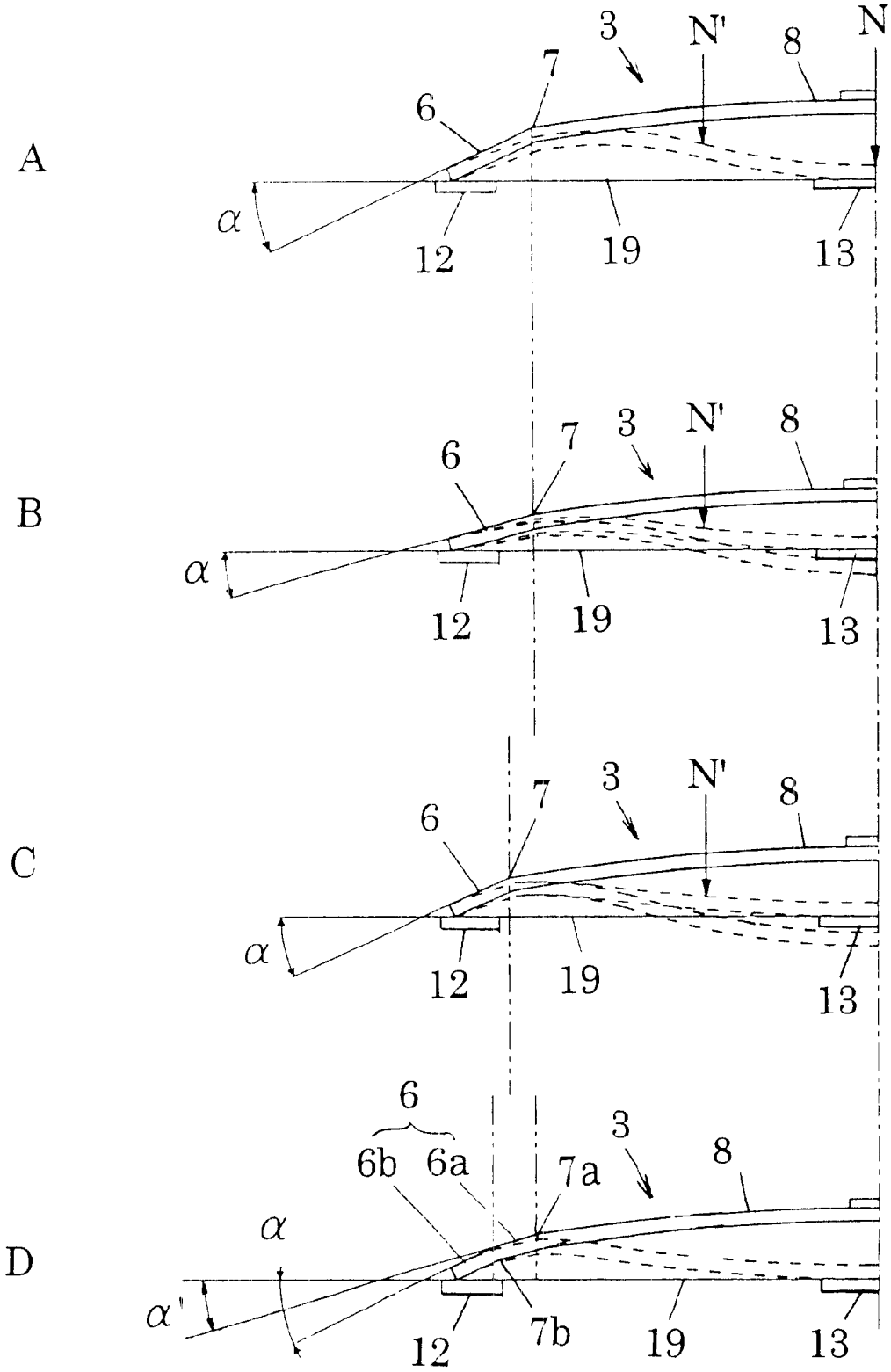
FIGS. 11 (A) to 11 (D) are views for explaining operations and functions of the contact spring according to the switch of the invention.

When the operating load N is imposed on the central part of the dome part 5 for operating the switch in the state of FIG. 11 (A), the contact spring 3 is reversed at the position close to the bent part 7. If the position where the operating load N is imposed is displaced from the central part of the dome part 5, an operating load N' for reversing the contact spring 3 becomes large, and the returning load also becomes large. As a result, clicking feeling becomes worse. Further, when the position where the operating load N' is imposed on approaches the outer periphery of the dome part 5, the returning load is sharply increased so that an area where the operating load N is imposed on (pressing area) becomes narrow. If this pressing area becomes narrow, when the contact spring 3 is disposed on the board 19 of a portable telephone and the like and used, the variations in clicking feeling of every switch keys, i.e. buttons of the portable telephone are increased when the positioning accuracy of the contact spring 3 is inferior relative to the board 19 so that high positioning accuracy is required, resulting in taking time and labor when assembling and inspecting the components, a marked tendency of which is shown, particularly, at present when the contact spring 3 is prone to be miniaturized. Further, an angle $\alpha$ of the skirt part 6 relative to the plane surface (bottom angle of a conical surface) is 25 °.

If the angle $\alpha$ of the skirt part 6 is made small to the extent of the 15° so as to reduce the returning load as shown in FIG. 11 (B), or the length of the skirt part 6 in the radial direction is made short as shown in FIG. 11 (C), the returning load becomes small, while a stroke required for completely reversing the contact spring 3 becomes large on the contrary. As a result, prior to the complete reverse of the contact spring 3, the edge part 10 strikes against the plane surface of the board 19 when the switch is operated, so that a required stroke falls short and incomplete clicking occurs, and hence clicking feeling becomes worse.

If the bending of the skirt part 6 is formed of double stepped one as shown in FIG. 11 (D), a sufficient stroke is ensured so that a bending angle (angle $\alpha$–angle $\alpha'$) of the second step, namely, a bending angle of the bent parts 7*a*, 7*b* can be made small. As a result, even if the operating load N is imposed on a position displaced from the central part of the dome part 5, the operating load N' for reversing the contact spring 3 is not increased, and the returning load is also reduced at the same time so that an area where the operating load N is imposed on (pressing area) becomes wide, and hence the clicking feeling becomes relatively better. Further, since the bending of the skirt part 6 is formed of double stepped one, and also the bending angle of the bent parts 7*a*, 7*b* of the skirt part 6 can be made small, a press mold is less abraded in a press bending working so that there occurs a small change in load characteristics and there don't occur variations in load characteristics, and hence the contact spring 3 becomes excellently stable in mass production.

Figure 12:
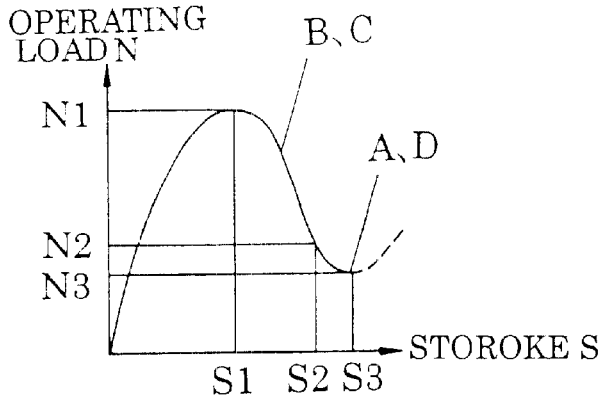
FIG. 12 is a graph showing a relation between a stroke of and an operating load imposed on the contact spring according to the switch of the invention.

FIG. 12 is a graph showing properties of the contact spring 3 as shown in FIGS. 11 (A) to (D), namely, an operating load N (axis of ordinance) imposed on the contact spring 3 relative to a stroke S (axis of abscissa) of the contact spring 3. According to the contact spring 3, as shown in FIGS. 11 (B) and (C) as described above, the edge part 10 strikes against the plane surface of the board 19 when the switch is operated, so that a required stroke S falls short and clicking becomes incomplete. On the other hand, the contact spring 3 as shown in FIGS. 11 (A) and (D) can ensure the sufficient stroke S so that complete clicking can be obtained.

Figure 13:
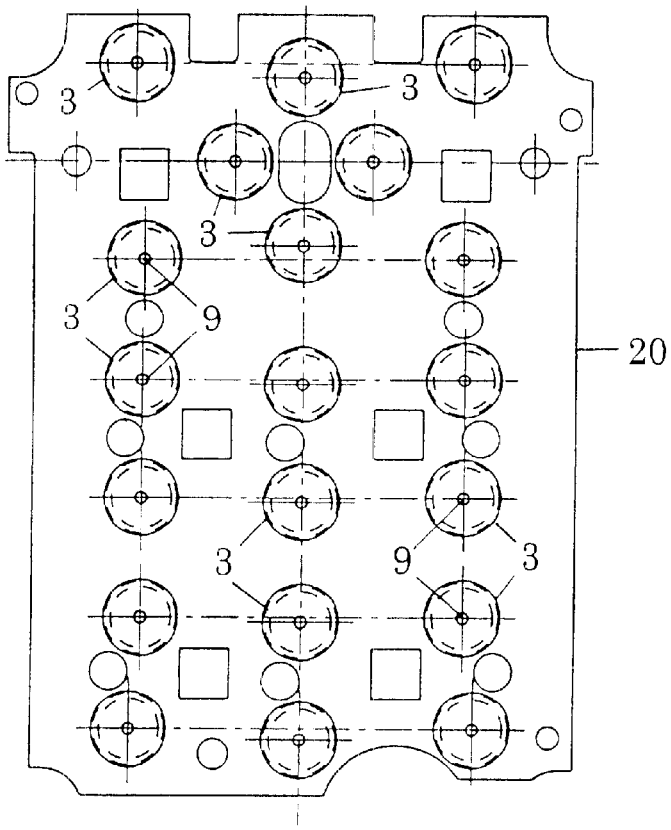
FIG. 13 is a rear view showing a state where contact springs of the invention are built in a switch board of a portable telephone.
Figure 14:
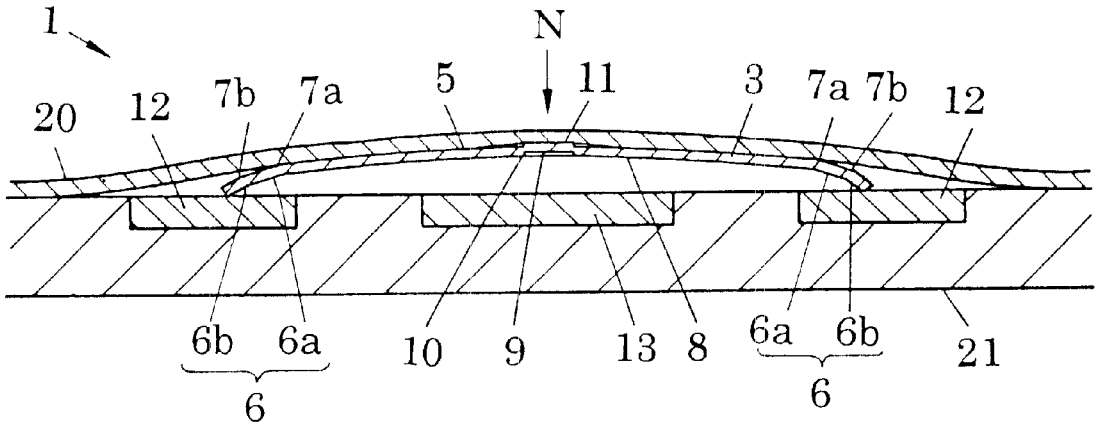
FIG. 14 is an enlarged sectional view of a main portion of the contact spring in a state where the contact spring of the invention is built in the switch board of the portable telephone.

FIGS. 13 and 14 show states where many contact springs 3 are built in a switch board of a portable telephone. Many contact springs 3 are stuck to an adhesive surface of an adhesive film 20 at each convex surface of the dome part 5 while they face the plane surface of a printed circuit board 21 at the concave part of the dome part 5, and hence the contact spring 3 and the printed circuit board 21 are combined with each other. With the combination of the contact spring 3 and the printed circuit board 21, the movable contact part 8 of each contact spring 3 corresponds to a fixed contact part 13 of the printed circuit board 21, and the end of the skirt part 6 contacts the contact segment 12 of the printed circuit board 21. Both the fixed contact part 13 and contact segment 12 are formed by a part of a conductive pattern on the plane surface of the printed circuit board 21.

Since the edge part formed on the periphery of the depression of the movable contact part of the contact spring contacts the surface of the fixed contact part by a line contact according to the invention, even if fine dust and the like are stuck on the contact part between the edge part and the fixed contact part, the contact pressure of the edge part of the movable contact part relative to the fixed contact part is increased, thereby ensuring an electric stability of contact between the movable contact part and the fixed contact part. Further, since the movable contact part of the contact spring has no hole, no dust enters the switch, and a tensile stress or a compression stress generated at the periphery of the depression becomes small compared with the size of the hole, and also the edge part hardly cracks, so that a life of the contact spring becomes long, and hence a stable switching function can be expected for a long period of time.

Since the skirt part keeps its configuration before it is reversed even if the dome part is reversed if the skirt part is formed by a part of conical surface at the outer peripheral edge part of the contact spring, an electric contact between an end of the skirt part and the contact segment can be ensured, and also electric characteristics can be stabilized. If the skirt part is formed of not less than a double step, a required stroke can be ensured even if a bending angle of the bent part is small, and also even if the part which is close to a position remote from the central part of the dome part is pressed, clicking feeling hardly becomes worse, while a stress imposed on the bent part is decreased by the double bent configuration of the outer peripheral portion, and hence variations in properties of each contact spring are reduced.

What is claimed is:

1. A switch comprising a dome-shaped contact spring having an inner central part and including a movable contact part formed at the inner central part, the movable contact part contacting a fixed contact part or breaking off the contact with the fixed contact part so as to render the movable contact part and the fixed contact part to be in one of an electrically on or off state, said contact spring including a depression formed on the movable contact part having a depth of not more than two-thirds of the thickness of the contact spring, and an edge part formed continuously about an entire periphery of the depression for contacting a surface of the fixed contact part to place the switch in one of the electrically on or off state.

2. The switch according to claim 1, wherein a central portion of the dome-shaped contact spring is formed in a dome part by a spherical surface, and wherein an outer peripheral edge part of the dome part is formed in a skirt part by conical surfaces, and an annular demarcating part between the dome part and the skirt part is formed in a bent part, and wherein the angle of the skirt part is not less than 15 degrees relative to an adjoining plane defined by an outer peripheral edge part of the skirt part.

3. The switch according to claim 2, wherein the skirt part comprises a first skirt part having a first conical surface and a second skirt part having a second conical surface different from the conical surface of the first skirt part, and wherein the annular demarcating part between the dome part and the skirt part comprises a first demarcating part and a second annular demarcating part between the adjacent skirt parts formed by bent parts.

4. The switch according to claim 2, wherein the depression of the movable contact part is formed in any of a circular, an elliptical, a polygonal and an astral shape.

5. The switch according to claim 1, wherein the depression of the movable contact part is formed in any of a circular, an elliptical, a polygonal and an astral shape.

6. A switch comprising a switch case which houses therein a dome-shaped contact spring and an operation button which is brought into contact with a top of the contact spring and is freely displaced in a direction of elastic deformation of the contact spring, wherein an outer periphery of the contact spring is brought into contact with a contact segment while an inner central portion of the contact spring serves as a movable contact part, and wherein the movable contact part contacts a fixed contact part or breaks off the contact with the fixed contact part inside the switch case, thereby rendering the movable contact part and the fixed contact part to be in one of an electrically on or off state, said switch further comprising a depression on the movable contact part, and an edge part formed continuously about an entire periphery of the depression for contacting a surface of the fixed contact part, the depression having a depth of not more than two-thirds of a thickness of the contact spring.

7. The switch according to claim 6, wherein the central portion of the dome-shaped contact spring is formed in a dome part by a spherical surface, and wherein an outer peripheral edge part of the dome part is formed in a skirt part by conical surfaces, and an annular demarcating part between the dome part and the skirt part is formed by a bent part.

8. The switch according to claim 7, wherein the skirt part comprises a first skirt part having a first conical surface and a second skirt part having a second conical surface different from the first conical surface of the first skirt part, and wherein the annular demarcating part between the dome part and the first skirt part and the annular demarcating part between the adjacent first and second skirt parts are formed by bent parts.

9. The switch according to claim 8, wherein the depression of the movable contact part is formed in any of an elliptical, a polygonal and an astral shape.

10. The switch according to claim 6, wherein the depression of the movable contact part is formed in any of an elliptical, a polygonal and an astral shape.

11. A push button switch comprising:

a housing having a base therein;

an annular contact segment and fixed contact part located at the base in the housing;

connection terminals connected to the annular contact segment and the fixed contact part;

a push button secured in said housing and including a button protrusion at a first end thereof and a second protrusion projecting outwardly from said housing for contact by a user operating the switch; and a dome-shaped contact spring located in the housing and comprising a dome part having a spherical shape and a skirt part extending outwardly about the entirety of an outer edge of the dome part, an outer edge of the skirt part contacting the annular contact segment, the dome-shaped contact spring having a first spherical shaped surface for contacting said button protrusion and a second inner surface adjacent said fixed contact part, said dome part including a protrusion projecting outwardly from said first spherical shaped surface to contact said button protrusion, wherein applying force to said push button moves said dome-shaped contact spring toward said base so that said dome part contacts said fixed contact part to operate said switch.

12. The switch according to claim 11, said dome part including a depression in said second inner surface corresponding to said protrusion and an edge part extending about said depression, wherein the application of force to said push button moves said dome-shaped contact spring toward said base so that said edge part contacts said fixed contact part to operate said switch.

13. The switch according to claim 12, wherein said depression has a depth of not more than two thirds of the thickness of the dome-shaped contact spring.

14. The switch according to claim 11, including an annular bent part extending about a circumference of said dome part and defining a demarcation between said dome part and said skirt part, wherein the application of force to said push button moves said dome part toward said base while said skirt part continues to extend outwardly away from said base.

15. The switch according to claim 14, wherein an angle of the skirt part is not less than 15 degrees relative to a plane defined by the outer edge of the skirt part.

16. The switch according to claim 11, said skirt part including a first section integral with said dome part and a second section extending outwardly from the first section and including the outer edge contacting the annular contact segment, a first annular bent part defining a demarcation between said first section and said second section, and a second annular bent part extending about a circumference of said dome part and defining a demarcation between said dome part and said first skirt part.

17. The switch according to claim 16, said dome-shaped contact spring including a depression in said second inner surface corresponding to said protrusion and an edge part extending about said depression, wherein the application of force to said push button moves said dome-shaped contact spring toward said base so that said edge part contacts said fixed contact part to operate said switch.

18. The switch according to claim 17, wherein said depression has a depth of not more than two thirds of the thickness of the dome-shaped contact spring.

19. A push button switch comprising:

a housing having a base therein;

an annular contact segment and fixed contact part located at the base in the housing;

connection terminals connected to the annular contact segment and the fixed contact part;

a push button secured in said housing and including a button protrusion at a first end thereof and a second protrusion projecting outwardly from said housing for contact by a user operating the switch; and a dome-shaped contact spring located in the housing and comprising a dome part having a spherical shape and a skirt part having a conical shape extending outwardly about the entirety of an outer edge of the dome part, an outer edge of the skirt part contacting the annular contact segment, the dome part having a first spherical shaped surface for contacting said button protrusion and a second inner surface adjacent said fixed contact part, said dome part including a depression in the second inner surface and an edge part formed continuously about an outer periphery of said depression, wherein applying force to said push button moves said dome-shaped contact spring toward said base so that said edge part contacts said fixed contact part to operate said switch.

20. The switch according to claim 19, wherein said depression has a depth of not more than two thirds of the thickness of the dome-shaped contact spring.

* * * * *